United States Patent [19]

Smith

[11] 3,954,331

[45] May 4, 1976

[54] TONER DISPENSER

[75] Inventor: Richard E. Smith, Webster, N.Y.

[73] Assignee: Xerox Corporation, Stamford, Conn.

[22] Filed: Nov. 20, 1974

[21] Appl. No.: 525,527

[52] U.S. Cl. ..... 355/3 DD; 118/637; 222/DIG. 1

[51] Int. Cl.[2] ..... G03G 15/00

[58] Field of Search ..... 355/3 DD, 15; 222/DIG. 1, 165; 118/637; 15/1.5; 427/18

[56] References Cited

UNITED STATES PATENTS

| | | | |
|---|---|---|---|
| 3,147,890 | 9/1964 | Mittelsteadt | 222/165 |
| 3,596,807 | 8/1971 | Hudson et al. | 222/DIG. 1 |
| 3,752,576 | 8/1973 | Gerbasi | 355/15 |
| 3,764,208 | 10/1973 | Takahashi et al. | 355/3 DD |
| 3,793,986 | 2/1974 | Latone | 355/15 X |

OTHER PUBLICATIONS

IBM Tech. Discl. Bulletin, Vol. 15, No. 4, Sept. 1972, "Toner Cart. w/Internal Toner Trans.", by Goff.

*Primary Examiner*—Robert P. Greiner

[57] ABSTRACT

A toner dispenser for a development system of an electrostatic processor has a removable reservoir which mates with a collar on a pivotally mounted hopper containing a dispensing roll. The reservoir may be slid into or out of the collar while upright, but after it is mounted the hopper is rotated to invert the reservoir so that there then is a gravitational flow of toner to the dispensing roll.

12 Claims, 4 Drawing Figures

TONER DISPENSER

BACKGROUND OF THE INVENTION

This invention relates to development systems for electrostatic processors and, more particularly, to In a conventional electrostatic printing process of the type described in Carlson's U.S. Pat. No. 2,297,691 on "Electrophotography", a uniformly charged photoreceptor is selectively discharged in an image configuration to provide a latent electrostatic image which is then developed through the application of a finely divided, resinous material, called "toner". As is known, that process has enjoyed outstanding commercial success, especially in plain paper copiers and duplicators. Nevertheless, substantial effort and expense are still being devoted to the perfection of the process, including the development step.

The vehicle normally used in electrostatic processors to deliver the toner is a multi-component developer comprising toner particles and relatively coarse "carrier" particles. The toner and carrier (or sometimes carrier coating) components are formed from materials which are removed from each other in the triboelectric series, thereby enabling a triboelectric charging process to be employed to induce electrical charges of opposite polarities on the toner and carrier particles. Furthermore, triboelectric ranking is taken into account while selecting the materials for those components to the end that the polarity of the charge imparted to the toner particles opposes the charge of the latent image. Thus, in operation, there are competing electrostatic forces acting on the toner particles. Specifically, those particles are initially attracted to carrier particles, but some toner is subject to being electrostatically stripped from the carrier whenever developer is brought into the immediate proximity of or actual contact with an image bearing photoconductor.

Experience has demonstrated that the useful life of a developer charge can be prolonged by adding additional toner to the developer from time-to-time. The additional toner is, of course, needed to maintain the toner concentration of the developer at a suitably high level inasmuch as toner is consumed in the development process. Hence, most development systems include a toner dispenser.

Briefly, a toner dispenser normally includes a reservoir for storing a supply of toner, together with means for feeding toner from the reservoir to, say, the sump of a development system. Some toner dispensers are more or less permanent fixtures, but there is a trend toward removable types. It has, in short, been recognized that in situ loading of a toner dispenser is not particularly desirable because of the risk that the processor will be contaminated by toner accidentally spilled during the loading of the reservoir. However, the pre-loaded, removably mounted toner dispensers previously proposed have not been altogether satisfactory. Most of them are relatively expensive units, and some are difficult to mount and remove.

SUMMARY OF THE INVENTION

Accordingly, an oject of this invention is to provide a relatively inexpensive toner dispenser having a reservoir which may be preloaded with toner. A more detailed, related object is to provide a toner dispenser with a removable reservoir which may be readily mated with and removed from the balance of the toner dispenser, without any appreciable risk of spilling toner.

A further object of this invention is to provide a toner dispenser of the foregoing type which is suitable for use in a development system having a split housing.

To carry out these and other objects of the invention, there is a toner dispenser having an open mouth, removable reservoir which mates with a pivotally mounted support containing a dispensing roll. The support and dispensing roll are rotatable about a generally horizontal axis through a full 180° so that the reservoir may not only be slid into and out of a collar on the support while right side up (i.e., mouth up), but also inverted to provide a gravitational flow of toner to the dispensing roll, all without appreciable risk of spilling significant amounts of toner. In operation, the dispensing roll is rotatably driven to feed toner from the reservoir. Desirably, it is coupled to the drive mechanism by a quick disconnect coupling, particularly if the toner dispenser is associated with a development system having a split housing. Advantageously, an electrostatic processor has a second reservoir which is interchangable with the reservoir for the toner dispenser and which is used at the cleaning station to collect the residual toner removed from the photoreceptor. In that event, the residual toner may be reclaimed simply by using the second reservoir as a replacement reservoir for the toner dispenser.

BRIEF DESCRIPTION OF THE DRAWINGS

Still further objects and advantages of this invention will become apparent when the following detailed description is read in conjunction with the attached drawings in which.

DETAILED DESCRIPTION OF THE ILLUSTRATED EMBODIMENT

While the invention is described in some detail hereinafter with reference to a single illustrated embodiment, it is to be understood that there is no intent to limit it to that embodiment. On the contrary, the aim is to cover all modifications, alternatives and equivalents falling within the spirit and scope of the appended claims.

Figure 1:
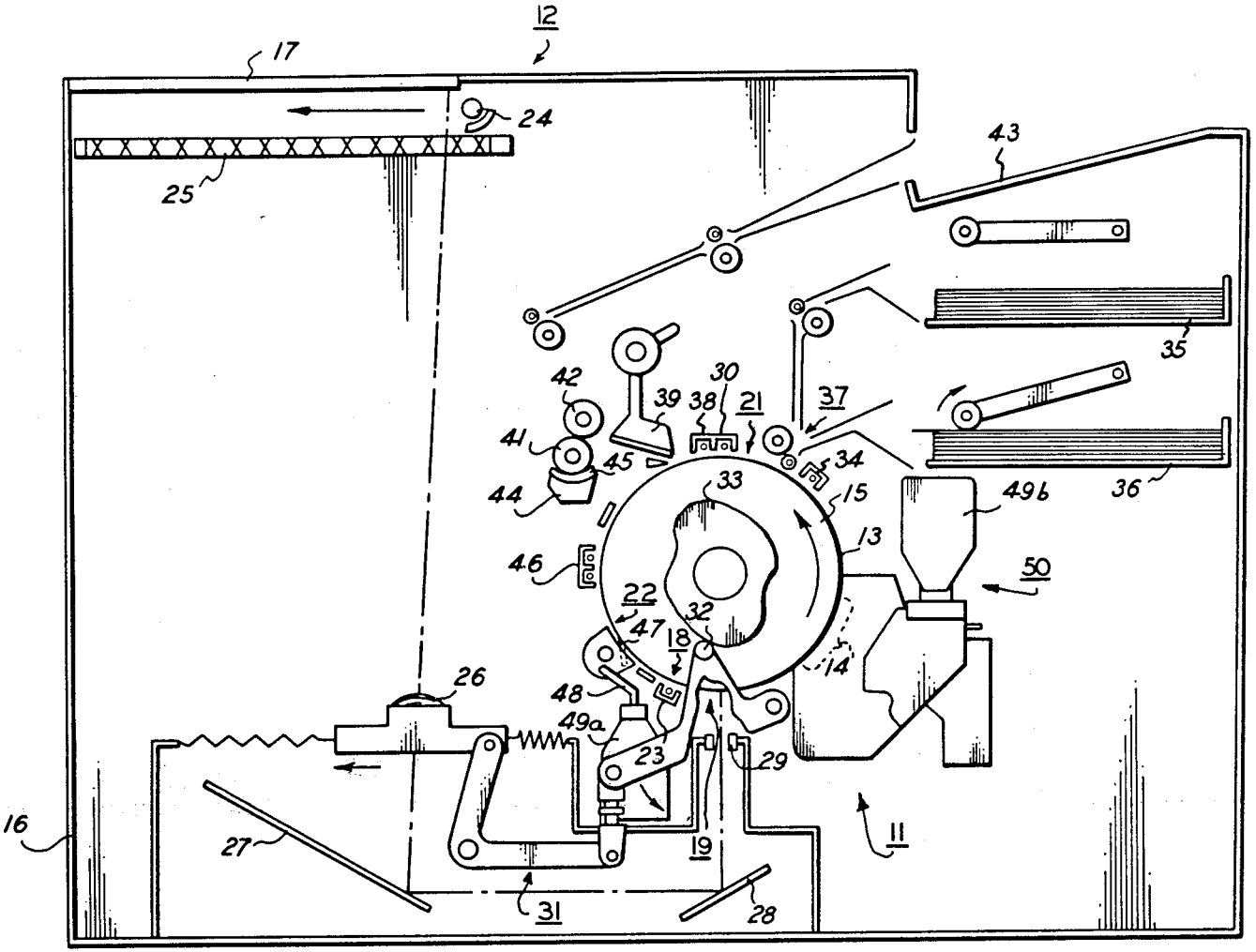
FIG. 1 is a simplified schematic diagram of an electrostatic processor having a magnetic brush development system with a toner dispenser constructed in accordance with the present invention.

Turning now to the drawings, and at this point especially to FIG. 1, it will be seen that the invention is embodied in a development system 11 which is used in an electrostatic processor 12 to develop latent electrostatic images carried by a photoconductor 13 on the fly — viz., as the photoconductor 13 moves through a development zone 14. In this instance, the photoconductor 13 is coated on the surface of a rotatable drum 15. It will be apparent, however, that there are other suitable machine configurations, including one wherein a flexible photoconductor is supported by a belt-like substrate.

There is no reason to dwell at length on the processor 12. It is simply an exemplary environment for the invention, and it closely resembles a commercially available "4000" copier of Xerox Corporation as modified to include the new development system 11. Thus, anyone interested in the specific details of that copier can inspect one of the commercially available units and refer to the published literature describing it, such as U.S. Pat. No. 3,724,019, which issued Apr. 3, 1973 in the name of Alan L. Shanly. Nevertheless, a brief functional description may be helpful.

Considering the processor 12 on that level, it will be observed that the drum 15 and its related components are enclosed within a base frame 16 which has a transparent platen 17 for supporting a document or other object (i.e., subject copy) image side down in position to be copied. The drum 15 is rotatably driven in the direction of the arrow (counterclockwise as shown) so that the photoconductor 13 is sequentially advanced during each copying cycle through a charging station 18, an exposure station 19, the development zone 14, a transfer station 21, and a cleaning station 22.

At the outset of each copying cycle, the photoconductor 13 is uniformly charged by a corona generator 23 as it advances through the charging station 18 and then selectively discharged in response to light reflected from the subject copy as it moves through the exposure station 19. There is, therefore, a latent electrostatic image of the subject copy of the photoconductor 13 when it reaches the development zone 14.

To carry out the exposure step, this particular copier comprises a scanning lamp 24 which is driven from one side to the other of the platen 17 during each copying cycle by a double helix auger drive 25 to illustrate successive lines or strips of the subject copy from below. The light reflected from the subject copy is intensity modulated in accordance with the image to be copied and is focused on the photoconductor 13 by a movable lens 26, a pair of stationary mirrors 27 and 28, and an exposure slit 29. To maintain the focus, the movable lens 26 is laterally driven in timed synchronism with the scanning lamp 24. That is accomplished by means of a linkage 31 which has a follower 32 riding on a camming surface 33 which, in turn, is mounted for rotation with the drum 15.

As described in detail hereinbelow, the development system 11 applies toner to develop the image carried by the photoconductor 13 as it advances through the development zone 14. The toner charge is then partially neutralized by a pre-transfer corona generator 34, thereby conditioning the toner image for transfer to a copy sheet under the influence of transfer corona generator 30 at the transfer station 21. The copy sheet is selectively fed from one of two supply trays 35 and 36 and is brought into contact with the photoconductor 13 by a sheet feeding and registration mechanism schematically shown at 37.

After the image has been transferred, the drum 15 rotates beneath a detack corona generator 38, which at least partially neutralizes the charge previously provided by the transfer corona generator 30, and then beneath a vacuum-type stripper 39. The stripper 39 removes the copy sheet from the photoreceptor 13 and transports it into a nip between a pair of heated fuser rolls 41 and 42.

The fuser rolls 41 and 42 supply heat and pressure for fixing the toner image to the copy sheet so that the copy which is ultimately fed into the output tray 43 has a substantial degree of permanence. To minimize the tendency for toner to offset during the fusing process, there is a reservoir 44 with a wick 45 for applying a release agent, such as silicone oil, to the lower fuser roll 41, which is the one that engages the image bearing side of the subject copy.

While fusing is taking place, the photoreceptor 13 continues to advance into the cleaning station 22 wherein there is a pre-cleaning corona generator 46 for at least partially neutralizing the charge tending to hold residual toner on the photoconductor 13, followed by a resilient cleaning blade 47 for wiping the residual toner from the photoconductor 13 in preparation for the next copying cycle. In keeping with one of the detailed aspects of this invention, the toner removed by the cleaning blade 47 is routed through a tube 48 into an open mouth or bottle-like reservoir interchangeable with the removable reservoir **49*b* of the toner dispenser 50 used in the development system 11. In that event, the residual toner can be reclaimed simply by using the bottle 40*a* as a replacement for the toner supply reservoir 49*a*.**

Figure 2:
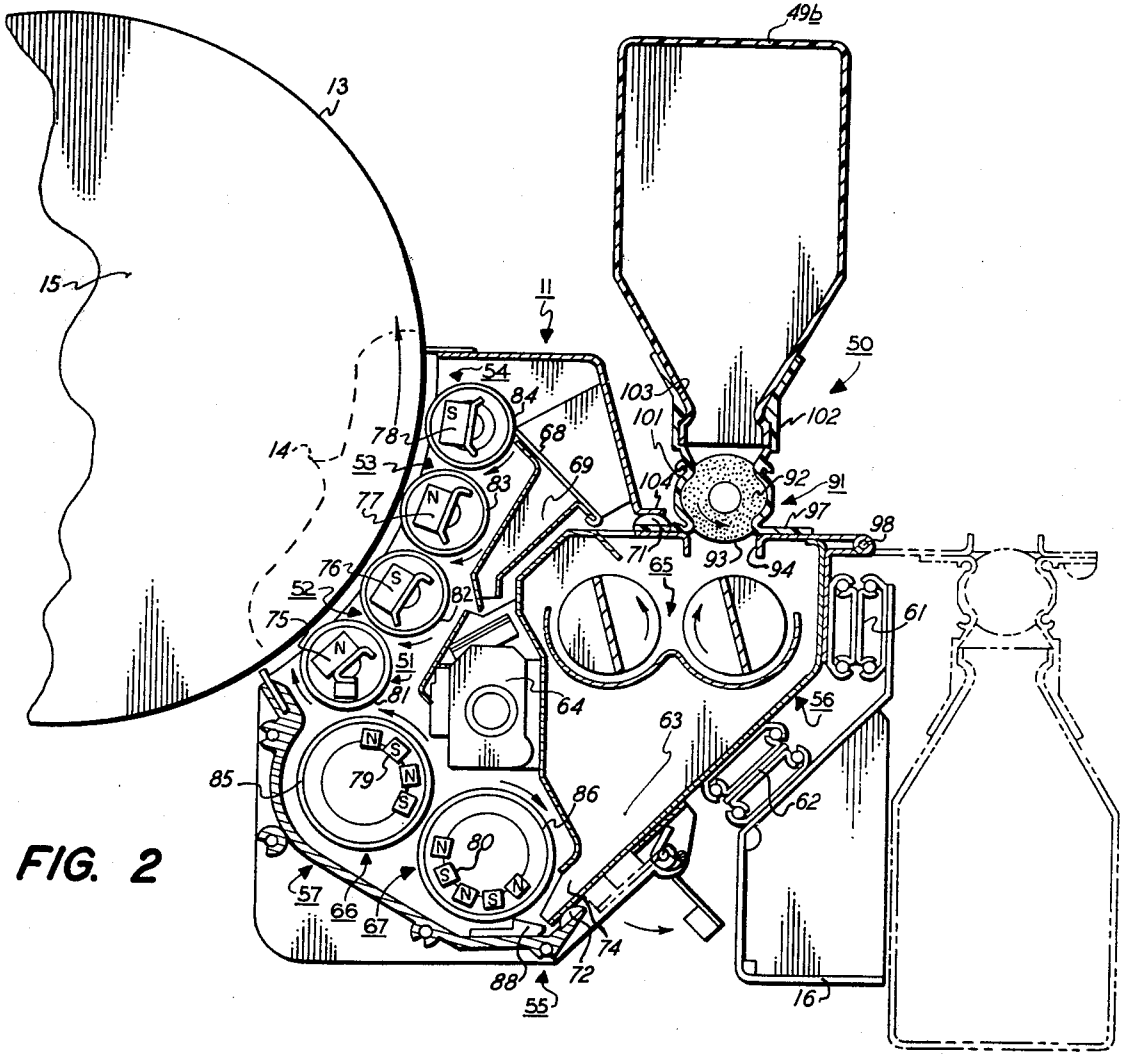
FIG. 2 is an enlarged, sectional view illustrating the basic components of the development system shown in FIG. 1.

As shown in FIG. 2, the development system 11 is a so-called "magnetic brush" unit having a series of four development rolls 51–54 for brushing the photoconductor 13 with the developer as it advances through the development zone 14. Suitably, the developer is a mixture of finely divided, resinous toner particles and larger, ferromagnetic carrier particles, such as is used in other development systems of this same general type.

Here, the development system 11 is equipped with a "split" housing 55 having a movable section 56 which is releasably secured to a stationary section 57 by a latching mechanism 58, as described and claimed in a concurrently filed and commonly assigned United States patent application of Richard E. Smith, Ser. No. 525,528 for "Split Housing for Electrostatic Development Systems" . Briefly, the movable section 56 is mounted on a pair of telescoping guides 61 and 62 for movement transversely of the development zone 14. Furthermore, that section includes the toner dispenser 50, a sump 63 for storing a supply of developer, an automatic development control (ADC)unit 64 for actuating the toner dispenser 50 whenever the toner concentration of the developer drops below a predetermined set point level, and a crossmixer 65 for reconditioning developer for recirculation. The stationary section 57, on the other hand, is more or less permanently anchored (by means not shown) to the base frame 16 and includes the development rolls 51–54, a tandem pair of magnetic transport rolls 66 and 67 for transporting developer from the sump 63 to the first or lowermost development roll 51, a downwardly inclined slide 68 for guiding developer from the last or uppermost development roll 54 toward the crossmixer 65, and a chute 69 for diverting developer from the slide 68 into the ADC unit 64.

Figure 3:
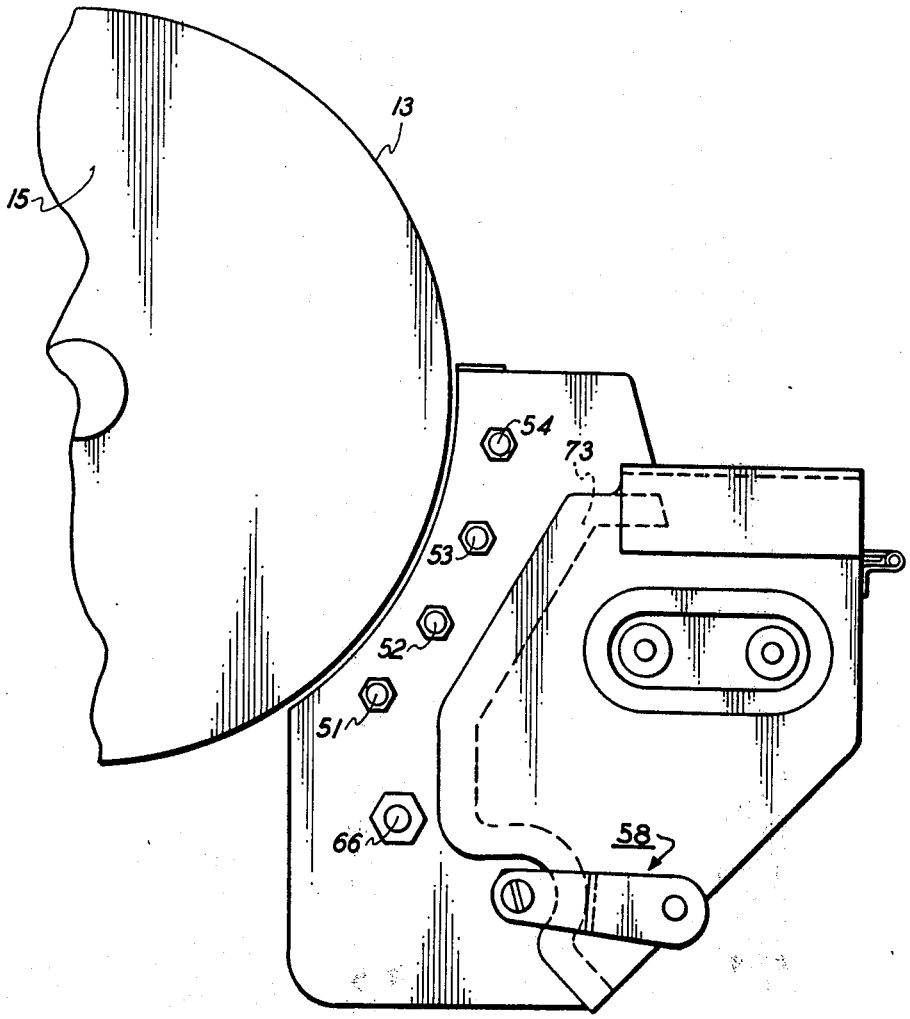
FIG. 3 is a side view of the housing for the development system, with certain parts being omitted in the interest of clarity.
Figure 4:
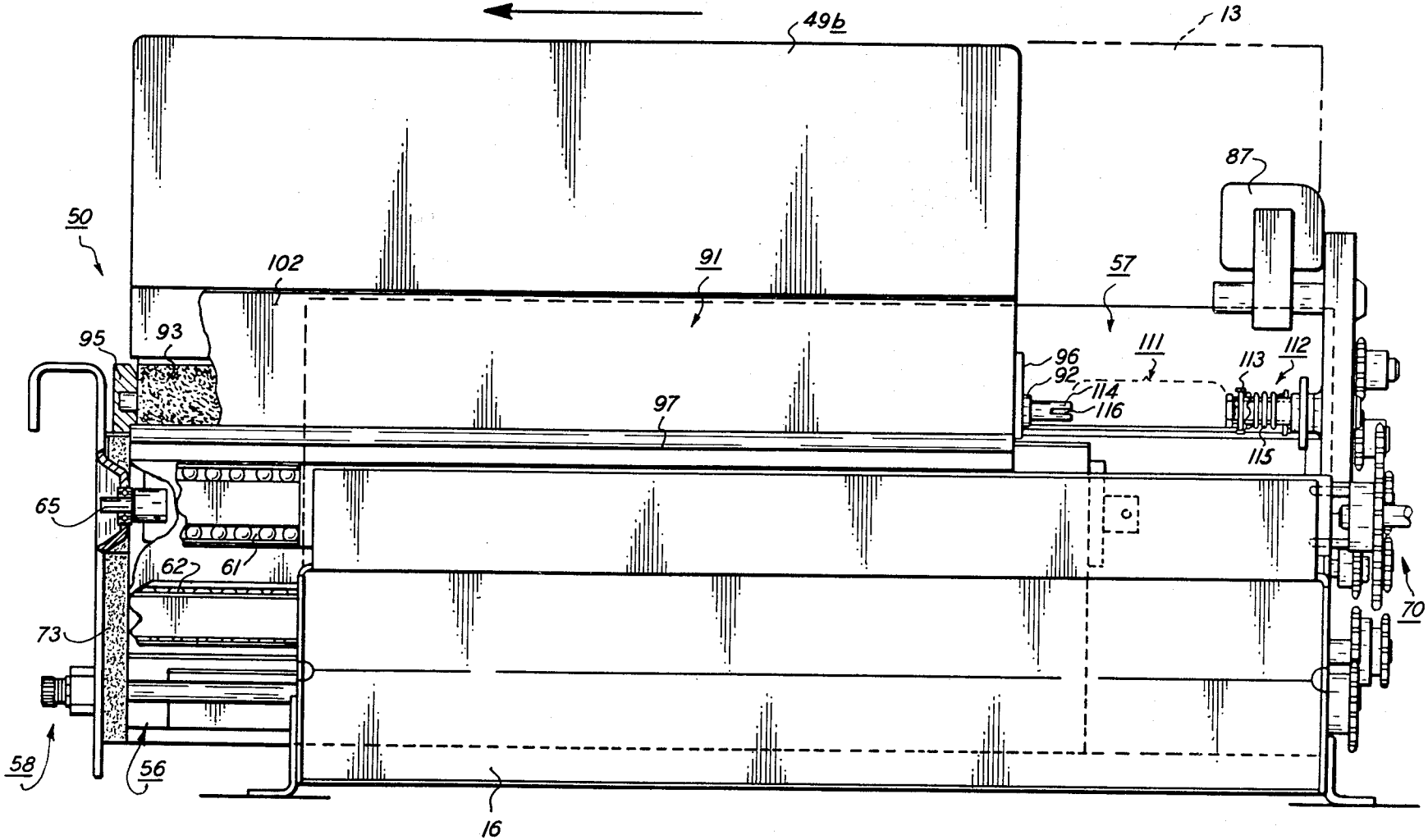
FIG. 4 is a rear view of the housing shown in FIG. 3, as seen when the housing is partially split.

Referring to FIGS. 2–4, there are gaskets, such as at 71–73, for sealing the two sections 56 and 57 of the housing 55 to each other when the latching mechanism 58 is engaged. Indeed, when the latching mechanism 58 is engaged and a drive mechanism 70 is activated, developer flowing through a discharge orifice 74 near the bottom of the sump 63 is transported along a generally S-shaped path by the transport rolls 66, 67 and then fed upwardly between the photoconductor 13 and successive ones of the development rolls 51–54. To that end, the development rolls 51–54 and the transport rolls 66,

67 comprise permanent magnet assemblies 75–80, respectively, which are supported within separate non-magnetic, cylinderical sleeves 81–86. The sleeves 81–86 are rotatably driven by the drive mechanism 70 so that the developer advances from roll-to-roll, as previously described, under the influence of the stationary fields provided by the magnetic assemblies 75–80. Characteristically, of course, the fields supplied by the magnetic assemblies 75–78 are shaped so that the developer entrained on the sleeves 81–84 of the development rolls 51–54 tends to collect in bristle-like stacks while passing between those rolls and the photoconductor 13, thereby causing that developer to brush against the photoconductor 13. Typically, provision is made to ensure that the "magnetic brushes" have a generally uniform profile width-wise of the development zone 14. Here, for example, there is a metering gate 88 for leveling the profile of the developer magnetically entrained on the first transport roll 67.

After passing between the photoconductor 13 and the last development roll 54, the developer is deposited on the slide 68. Some of the developer is then routed into the ADC unit 64 via the chute 69, but most of it remains on the slide 68 until it reaches the crossmixer 65. There, the developer is reconditioned for recirculation and then returned to the sump 63, as described and claimed in a concurrently filed and commonly assigned application of Richard E. Smith, Ser. No. 525,531 for "Active Crossmixer".

Concentrating on FIGS. 2 and 4, attention can be focused on the toner dispenser 50 now that a typical environment is firmly in mind. In keeping with other devices of this same general type, the toner dispenser 50 has a hopper-like support 91 containing a dispensing roll 92 which is rotatably driven in operation by a motor 87 to feed metered amounts of toner into the sump 63 of the development system 11. As is known, the dispensing roll 92 is typically covered with a polyurethane foam 93 so that it may be used not only to dispense toner but also to seal the hopper 91 under quiescent conditions (i.e., when the dispensing roll 92 is at rest). Advantageously, the additional toner provided by the toner dispenser 50 enters the housing 55 through an inlet opening 94 located directly above the crossmixer 65, thereby ensuring that the toner is thoroughly blended and mixed in with the recirculating developer while enroute to the sump 63.

An especially noteworthy feature is that the toner reservoir **49*b* is removably mounted on the hopper 91. Even more importantly the reservoir 49*b* is inverted in operation to provide a gravity flow of toner to the dispensing roll 92, but provision is made for re-inverting the reservoir 49*b* so that it may be mounted on and removed from the hopper 91 while it is upright. To carry out this feature of the invention, as shown, the dispensing roll 92 is journalled in the opposed end walls 95 and 96 of the hopper 91 which, in turn, has its base 97 pivotally mounted as at 98 on the movable section 56 of the housing 55. The opposed side walls 101 and 102 of the hopper 91 closely cup the dispensing roll 92 to perfect the aforementioned seal and include extensions which define a collar 103 having a configuration conforming to the contour of, say, the neck of the reservoir 49*b*. Furthermore, the pivot 98 defines a generally horizontal axis of rotation for the hopper 91. Thus, the reservoir 49*b* may be mounted on or removed from the hopper 91 while upright simply by rotating the hopper 91 in one direction about the pivot 98 to its phantom line position (FIG. 2) and then sliding the reservoir 49*b* into or out of the collar 103. Moreover, after the reservoir 49*b* has been mounted, the hopper 91 may be rotated in the opposite direction about the pivot 98 to invert the reservoir 49*b* and to position the toner dispenser 50 in its solid line position over the inlet opening 94. Of course, the sealing action of the dispensing roll 93 prevents any appreciable amounts of toner from being spilled while the reservoir 49*b*** is being inverted or re-inverted.

Here, there is a lip 104 on the stationary section 57 of the housing 55 which overlies the base 97 of the hopper. 91, except when the housing 55 is split. Alternative provision, however, could easily be made for releasably anchoring the toner dispenser 50 in place if it is desired to apply this invention to a development system having a more conventional housing.

Another important aspect of the toner dispenser 50 is that the dispensing roll 92 is engaged with and disengaged from the drive motor 87 in response to the movement of the movable section 56 of the housing 55. To that end, there is a quick disconnect coupling 111. Specifically, the drive shaft of the motor 87 includes a female member 112 having a pin 113 for mating with a notched male member 114 secured to the dispensing roll 92. The pin 113 is biased by a spring 115 so that it firmly seats in the notch 116 of the male member 114 shortly after the motor 87 is actuated, even should the pin 113 and notch 114 by initially misaligned when the movable section 56 is returned to close the housing 55. In other words, the coupling 111 is self engaging.

CONCLUSION

In view of the foregoing, it will now be understood that this invention provides a toner dispenser which is readily loaded with toner, without any significant risk of spilling appreciable amounts of toner. Indeed, it will be appreciated that the removable reservoir is not only suited to that end, but also a convenient means for reclaiming the toner recovered at the cleaning station of an electrostatic processor. Also, it will be understood that the quick disconnect coupling is a valuable addition to toner dispensers intended for use with development systems having split housings.

This application is addressed to the toner dispenser per se since there is a concurrently filed and commonly assigned application of Richard E. Smith et al., Ser. No. 525,438, directed toward the interchangability of the reservoirs for the toner dispenser and cleaning station.

What is claimed is:

1. A development system for developing latent electrostatic images; said development system having a housing containing a sump for storing a supply of developer, and a toner dispenser for feeding toner into said sump; said toner dispenser comprising a hopper, a rotatable dispensing roll journalled in said hopper, a reservoir for storing a supply of toner removably mounted on said hopper, and means for pivotally mounting said hopper on said housing so that said reservoir may be selectively inverted and re-inverted.

2. The development system of claim 1 wherein said dispensing roll seals said hopper under quiescent conditions.

3. The development system of claim 1 wherein at least a portion of said reservoir has a predetermined contour, and said hopper includes a collar conforming to said contour, whereby said reservoir is mounted on and removed from said hopper by sliding said portion into and out of, respectively, said collar.

4. The development system of claim 1 wherein said housing comprises a stationary section and a movable section, and said hopper is pivotally mounted on said movable section; and said development system further includes a drive mechanism, and a quick disconnect coupling means between said dispensing roll and said drive mechanism for engaging and disengaging said dispensing roll with and from, respectively, said drive mechanism.

5. The development system of claim 4 wherein said coupling means includes a notched male member and a female member having a pin biased to seat in said notch.

6. A toner dispensing arrangement comprising:

a hopper having an inlet opening and an outlet opening, means for pivotally mounting said hopper for movement between a toner dispensing position and a toner loading position, dispensing control means mounted in said hopper intermediate said inlet and outlet openings for preventing the passage of toner through said hopper when in a first condition and for permitting the passage of toner, on demand, through said hopper when in a second condition, a container for storing a supply of toner, said container having a discharge port, and coupling means for attaching said container to said hopper so that toner may flow from said container into said inlet opening when said hopper is in the toner dispensing position and may flow away from said discharge opening when said hopper is in the toner loading position, whereby said container may be attached and detached from said hopper without toner spillage.

7. The combination recited in claim 6 wherein said coupling means comprises mating formations on said container and hopper.

8. The combination recited in claim 6 wherein said container has a portion of predetermined contour associated with said discharge port, and said hopper includes a collar conforming to said contour, whereby said container is mounted on and removed from said hopper by sliding said portion into and out of said collar.

9. The combination recited in claim 6 wherein movement of said hopper to said toner dispensing position places said dispensing control means in said second condition and movement of said hopper to said toner loading position places said dispensing control means in said first condition.

10. The combination recited in claim 9 wherein said dispenser control means comprises a foam roll, said roll located in a portion of said hopper having a width smaller than the outer dimension of said roll, and means for rotating said roll, whereby rotation of said roll permits controlled passage of toner through said hopper and non-rotation of said roll prevents such passage.

11. The combination recited in claim 6 wherein said toner dispensing position of said hopper is disposed approximately 180° from said toner loading position.

12. The combination recited in claim 6 further including developer housing having a sump for storing a supply of toner, said hopper, when in said toner dispensing position, being located vertically above said sump to permit gravity feed of toner flowing through said hopper to said sump.

* * * * *